US011326596B2

(12) United States Patent
Peng et al.

(10) Patent No.: US 11,326,596 B2
(45) Date of Patent: May 10, 2022

(54) ROTARY SCREW COMPRESSOR

(71) Applicant: FUSHENG INDUSTRIAL (SHANGHAI) CO., LTD., Shanghai (CN)

(72) Inventors: Yung-Sheng Peng, New Taipei (TW); Yu-Feng Wu, Taipei (TW); Feng-Yung Lin, New Taipei (TW)

(73) Assignee: FUSHENG INDUSTRIAL (SHANGHAI) CO., LTD., Shanghai (CN)

( * ) Notice: Subject to any disclaimer, the term of this patent is extended or adjusted under 35 U.S.C. 154(b) by 148 days.

(21) Appl. No.: 16/837,750

(22) Filed: Apr. 1, 2020

(65) Prior Publication Data

US 2020/0370554 A1 Nov. 26, 2020

(30) Foreign Application Priority Data

May 20, 2019 (CN) ..... 201910421109.5

(51) Int. Cl.
*F04C 3/00* (2006.01)
*F04C 15/00* (2006.01)
(Continued)

(52) U.S. Cl.
CPC ..... *F04C 3/00* (2013.01); *F04C 15/0096* (2013.01); *F04C 2240/10* (2013.01);
(Continued)

(58) Field of Classification Search
CPC .... F04C 3/00; F04C 15/0096; F04C 29/0007; F04C 29/042; F04C 29/04; F04C 18/16
See application file for complete search history.

(56) References Cited

U.S. PATENT DOCUMENTS

2002/0150484 A1* 10/2002 Rival ..... F04C 23/00 417/410.4
2003/0035731 A1* 2/2003 Kim ..... F04C 29/04 417/205
(Continued)

FOREIGN PATENT DOCUMENTS

| | | | |
|---|---|---|---|
| EP | 1366297 | A1 | 12/2003 |
| GB | 2376505 | A | 12/2002 |
| WO | WO020700900 | A1 | 9/2002 |

OTHER PUBLICATIONS

Search Report dated Jul. 10, 2020 of the corresponding European patent application No. EP20168553.4.

*Primary Examiner* — Deming Wan
(74) *Attorney, Agent, or Firm* — Chun-Ming Shih; HDLS IPR Services

(57) ABSTRACT

A rotary screw compressor includes a compressor assembly and a drive motor assembly. The compressor assembly includes a compressor housing, a first screw rotor and a second screw rotor installed in the compressor housing and engaged with each other. An end of the first screw rotor is an engaging end. The drive motor assembly includes a motor housing, a motor rotor, a motor stator and a centering bushing installed in the motor housing, and the motor stator installed on an outer side of the motor rotor and capable of driving the motor rotor to rotate, and the centering bushing is passed and connected to the inner circumference of the motor rotor and has an end sheathed on the engaging end, so that the motor rotor can drive the first screw rotor to rotate through the centering bushing and the engaging end.

16 Claims, 7 Drawing Sheets

(51) Int. Cl.
*F04C 29/04* (2006.01)
*F04C 18/16* (2006.01)
*F04C 29/00* (2006.01)

(52) U.S. Cl.
CPC ..... *F04C 2240/20* (2013.01); *F04C 2240/30* (2013.01); *F04C 2240/50* (2013.01)

(56) References Cited

U.S. PATENT DOCUMENTS

| | | | | |
|---|---|---|---|---|
| 2004/0086396 | A1* | 5/2004 | De Smedt | F04C 18/16 417/372 |
| 2007/0241627 | A1* | 10/2007 | Kharsa | F04C 29/0085 310/156.08 |
| 2019/0063738 | A1 | 2/2019 | Hamada et al. | |

* cited by examiner

ROTARY SCREW COMPRESSOR

BACKGROUND OF THE INVENTION

1. Technical Field

The technical field relates to a compressor, and more particularly to a rotary screw compressor.

2. Description of Related Art

In general, a conventional rotary screw compressor comprises a compression chamber, a male rotor, a female rotor and a drive motor, and the male rotor and the female rotor are installed in the compression chamber and engaged with each other, and the drive motor comprises a motor housing and a drive shaft rotatably installed to the motor housing, and a bearing driving part is installed between the drive shaft and the male rotor for connecting their connection, so that the drive shaft can drive the male rotor to rotate through the bearing driving part, and the male rotor further drives the female rotor to rotate and jointly performing a compression operation.

However, it is necessary to connect the bearing driving part to the male rotor at the front end of the aforementioned drive shaft and have a bearing position between the rear end of the drive shaft and the motor housing, and the bearing driving part is a complicated component, so that the motor housing requires sufficient space to accommodate these components, and the volume of the rotary screw compressor cannot be reduced. In addition, it is necessary to lubricate the bearing at the rear end of the drive shaft, so that the coolant will flow through the bearing at the rear end of the drive shaft first and then into the compression chamber, but the coolant may permeate from the bearing at the rear end of the drive shaft into the motor housing and may cause an overheat or damage of the drive motor. Furthermore, the drive shaft drives the male rotate to rotate through the bearing driving part, and thus there is a transmission loss.

In view of the aforementioned drawbacks of the prior art, the discloser of this disclosure based on years of experience in the related industry to conduct extensive research and experiment, and finally provided a feasible solution as disclosed in this disclosure to overcome the drawback of the prior art.

SUMMARY OF THE INVENTION

Therefore, it is a primary object of this disclosure to provide a rotary screw compressor, wherein a centering bushing is passed and coupled into a motor rotor and an end of the centering bushing is sheathed on the first screw rotor to achieve the effects of reducing the volume and simplifying the structure of the rotary screw compressor, extending the service life of the drive motor assembly, and reducing the transmission loss.

In an embodiment of this disclosure, a rotary screw compressor comprises: a compressor assembly, further comprising a compressor housing, a first screw rotor and a second screw rotor installed in the compressor housing and engaged with each other, and an end of the first screw rotor having an engaging end; and a drive motor assembly, further comprising a motor housing and a motor rotor, a motor stator and a centering bushing installed in the motor housing, and the motor stator being installed to an outer side of the motor rotor and capable of driving the motor rotor to rotate, and the centering bushing being coupled into the motor rotor and having an end for accommodating the engaging end, so that the motor rotor can drive the first screw rotor to rotate through the centering bushing and the engaging end.

Based on the aforementioned structure, the centering bushing is used to substitute the conventional drive shaft. Since the centering bushing no longer require bearings or bearing driving parts, therefore the space for accommodating such bearings or bearing driving parts can be saved, the overall volume of the rotary screw compressor can be decreased, the structure can be simplified, and the transmission loss can be reduced.

Since both ends of the centering bushing require no lubrication of coolant, therefore the coolant can flow through the motor housing to cool the drive motor assembly without passing through both ends of the centering bushing. As a result, the coolant is prevented from permeating from both ends of the centering bushing into the motor housing, and the service life of the drive motor assembly can be extended.

DESCRIPTION OF THE PREFERRED EMBODIMENTS

Figure 1:
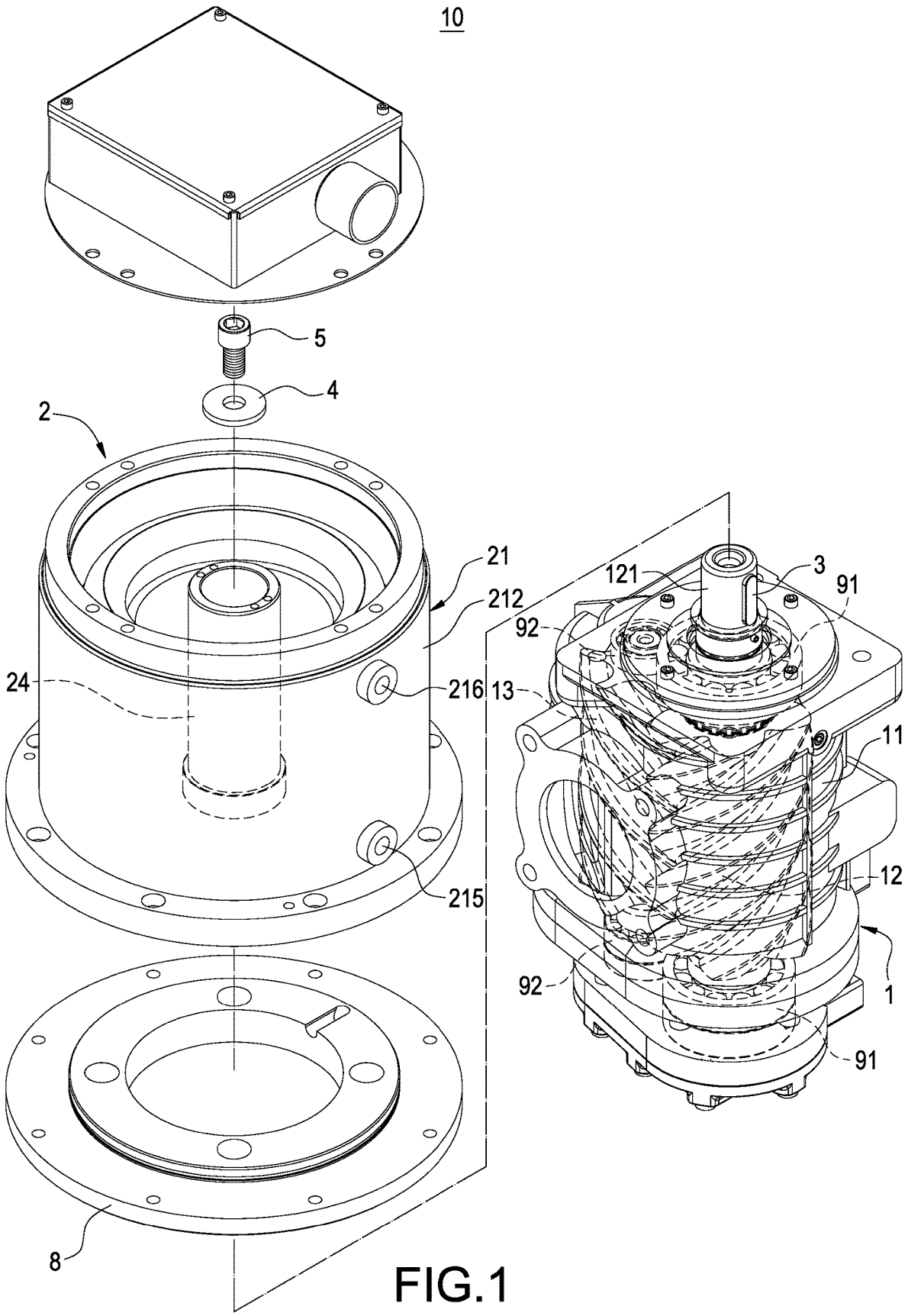
FIG. 1 is an exploded view of a rotary screw compressor of this disclosure.

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 6 for a rotary screw compressor of this disclosure, the rotary screw compressor 10 comprises a compressor assembly 1 and a drive motor assembly 2.

As shown in FIGS. 1 to 4, the compressor assembly 1 comprises a compressor housing 11 installed in the compressor housing 11, and a first screw rotor 12 and a second screw rotor 13 engaged with each other, and an end of the first screw rotor 12 has an engaging end 121. Wherein, the compressor housing 11 has a compression chamber 111 for accommodating the first screw rotor 12 and the second screw rotor 13.

Figure 3:
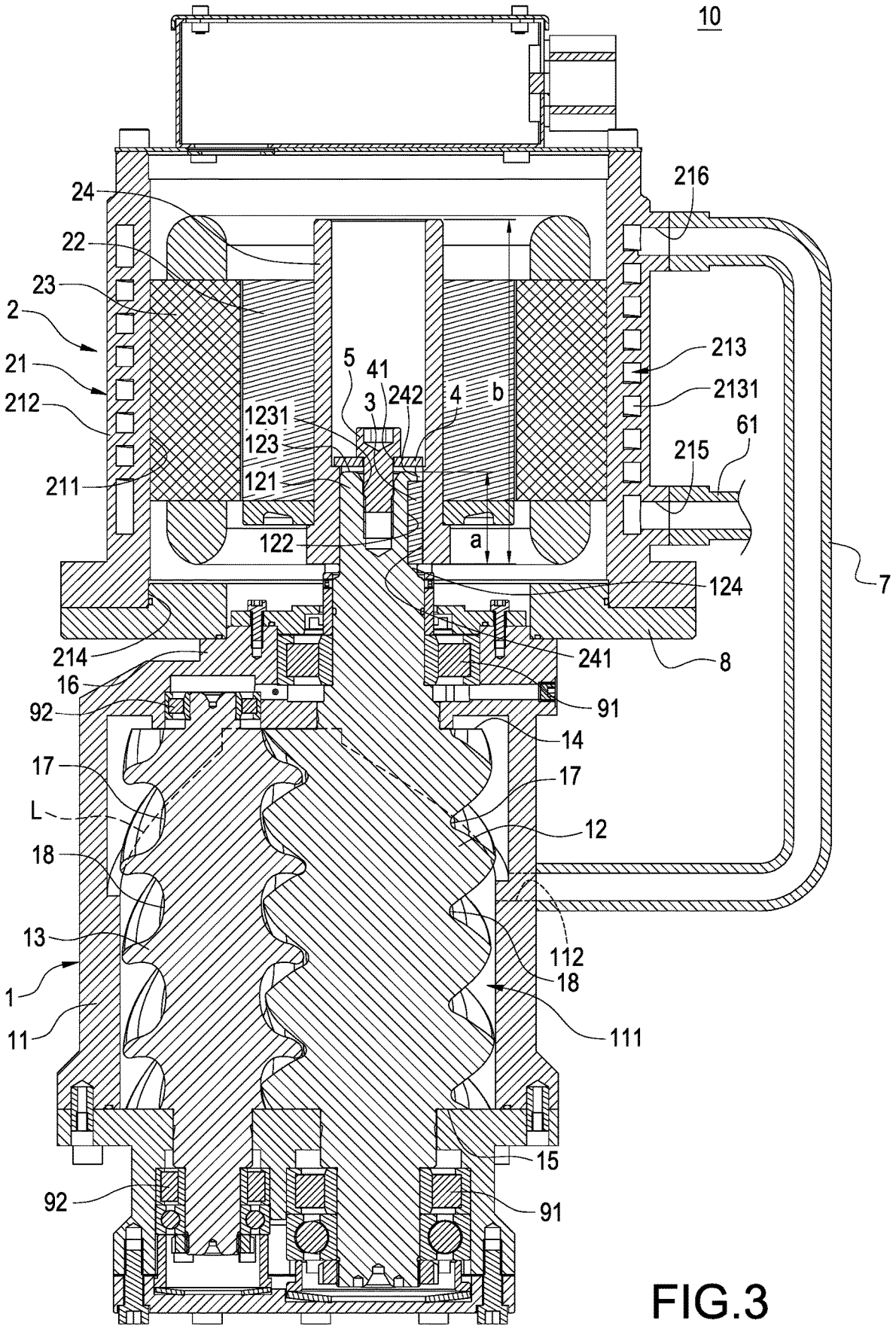
FIG. 3 is a cross-sectional view of a rotary screw compressor of this disclosure.

Referring to FIG. 3, both ends of the first screw rotor 12 and the second screw rotor 13 have an air suction end 14 and an air exhaust end 15 respectively, and a sealing line L is defined between the air suction end 14 and the air exhaust end 15, and the area between the air exhaust end 15 and the sealing line L is defined as a compression operation area, and the area between the air suction end 14 and the sealing line L is defined as an initial compression operation area.

Further, the first screw rotor 12 and the second screw rotor 13 has a first spiral groove 17 and a second spiral groove 18 counting from the air suction end 14, and the initial compression area is substantially disposed between the air suction end 14 and the second spiral groove 18.

As shown in FIGS. 1 to 6, the drive motor assembly 2 comprises a motor housing 21, a motor stator 23, a centering bushing 24 and a motor rotor 22 installed in the motor housing 21, and the motor stator 23 is installed to an outer side of the motor rotor 22, and the motor stator 23 drives the motor rotor 22 to rotate by the principle of electromagnetic induction, and the centering bushing 24 is coupled to the motor rotor 22 in a tight fit manner, and has an end for accommodating the engaging end 121 in the tight-fit manner, so that the motor rotor 22 can drive the centering bushing 24 to rotate, and the centering bushing 24 can drive the engaging end 121 to rotate, so that the motor rotor 22 can drive the first screw rotor 12 to rotate through the centering bushing 24 and the engaging end 121. The motor housing 21 has an inner surface 211 and an outer surface 212, and an air gap of 1 mm is maintained between the motor rotor 22 and the motor stator 23, but the size is not limited to 1 mm.

In the aforementioned tight fit method, the centering bushing 24 is passed and installed into the thermally expanded motor rotor 22, and the motor rotor 22 will be bounded tightly and naturally with the centering bushing 24 after cooling, and the engaging end 121 is passed and installed into the thermally expanded centering bushing 24, and the centering bushing 24 will be bounded tightly and naturally with the engaging end 121 after cooling. In FIGS. 1 and 3, the rotary screw compressor 10 of this disclosure further comprises an insert key 3, and the engaging end 121 has a first snap slot 122 formed along the axial direction thereof, and the centering bushing 24 has a second snap slot 241 formed along the axial direction thereof, and the insert key 3 is snapped into the first snap slot 122 and the second snap slot 241, and the first screw rotor 12 and the centering bushing 24 use the insert key 3 to perform a mechanical transmission, and an axial hole for the interference fit of the concentric alignment, so that the centering bushing 24 and the first screw rotor 12 can be fixed securely with each other and rotated jointly.

Further referring to FIGS. 1 and 3, the rotary screw compressor 10 of this disclosure further comprises a gasket 4 and a bolt 5, and the engaging end 121 has an extremity 123 and a stop block 124 extending therefrom, and the extremity 123 has a first through hole 1231, and the gasket 4 has a second through hole 41, and a protrusion 242 is extended from an inner periphery of the centering bushing 24, and the bolt 5 is locked into the first through hole 1231 and the second through hole 41, and the gasket 4 is clamped between the extremity 123, the protrusion 242 and the bolt 5, and the stop block 124 and the centering bushing 24 block and position with each other, so that the engaging end 121 has an end for blocking and limiting a position through the gasket 4 and the other end for blocking and limiting a position through the stop block 124, so as to connect the engaging end 121 into the centering bushing 24 stably.

Figure 4:
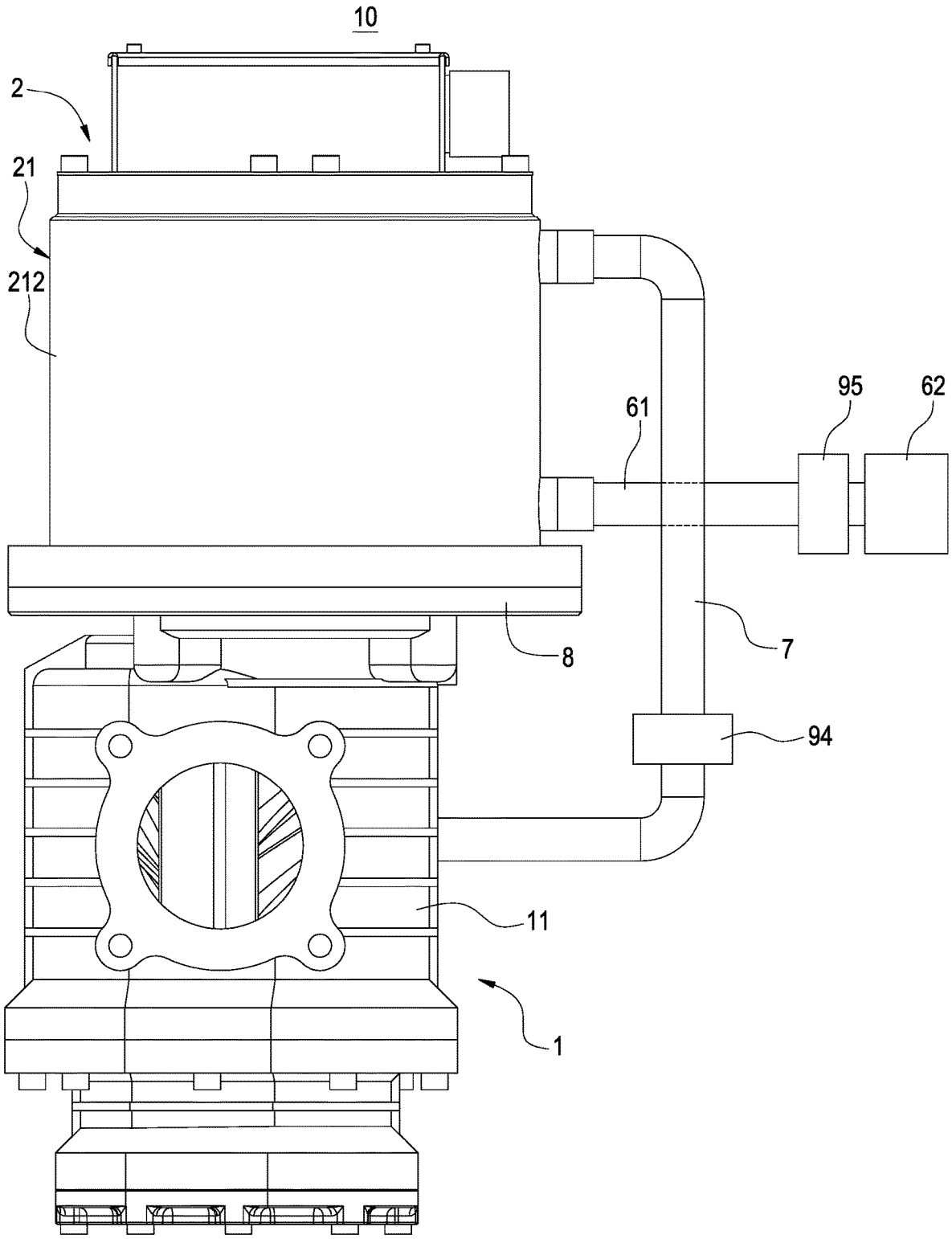
FIG. 4 is a side view of a rotary screw compressor of this disclosure.

Referring to FIGS. 3 and 4, the rotary screw compressor 10 of this disclosure further comprises a filling tube 61, a storage tank 62 and a guide tube 7, and the motor housing 21 has a cooling passage 213 formed between the inner surface 211 and the outer surface 212, and the filling tube 61 has an end just communicating to the storage tank 62 only and the other end just communicating to the cooling passage 213 only, and the guide tube 7 has an end just communicating to the cooling passage 213 only and the other end just communicating to the compression chamber 111 only, and a coolant sequentially flows through the liquid tube 6, the cooling passage 213 and the guide tube 7 to the compression chamber 111, and the compressor housing 11 has a first opening 112 between the compression chamber 111 and the guide tube 7, and the first opening 112 is disposed between the first spiral groove 17 and the second spiral groove 18 of any one of the first screw rotor 12 and the second screw rotor 13. In other words, the first opening 112 of the compressor housing 11 is situated in the initial compression operation area, which is at a low to mid pressure area of the compression chamber 111.

Figure 5:
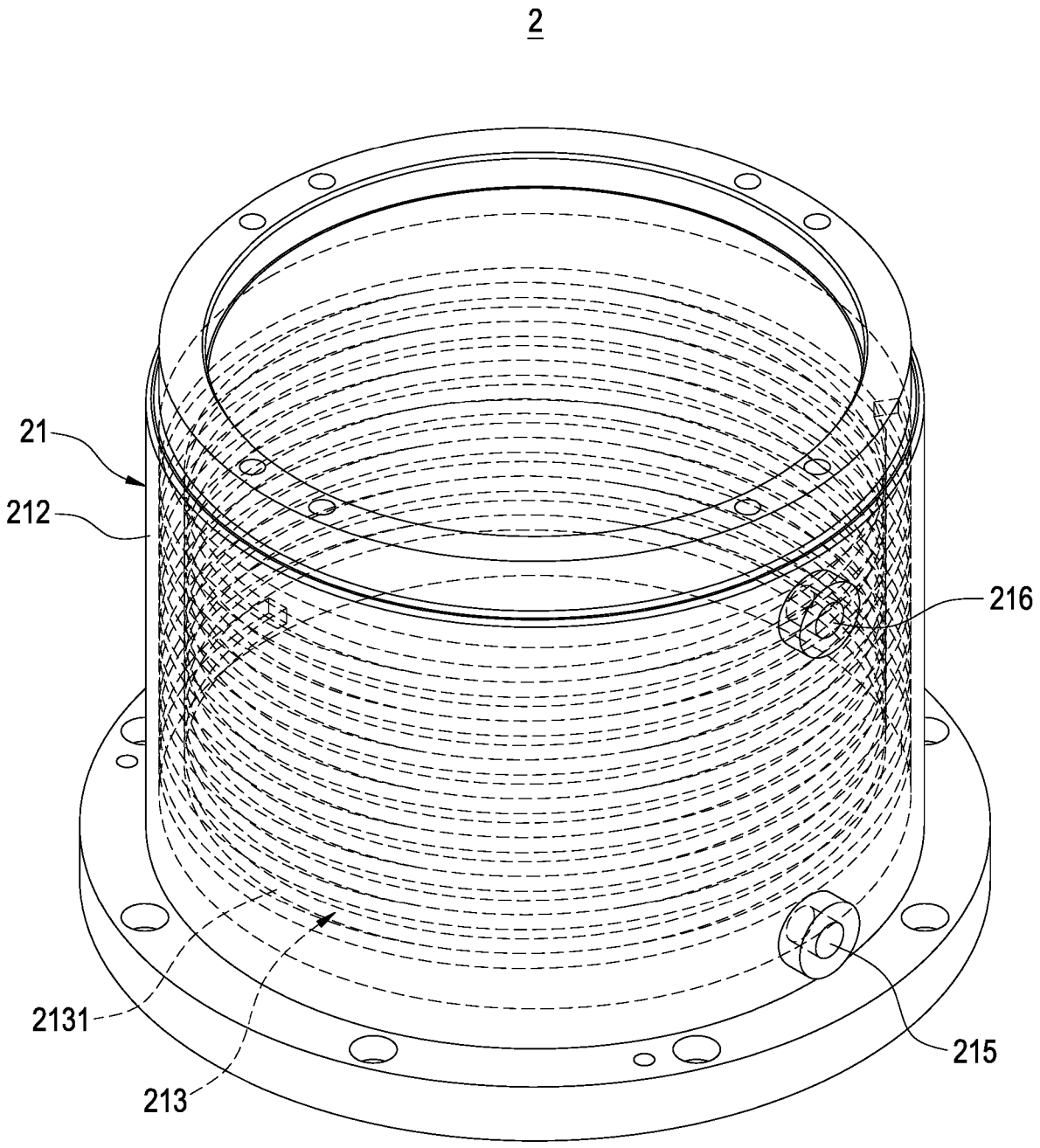
FIG. 5 is a perspective view of a motor housing of this disclosure.
Figure 6:
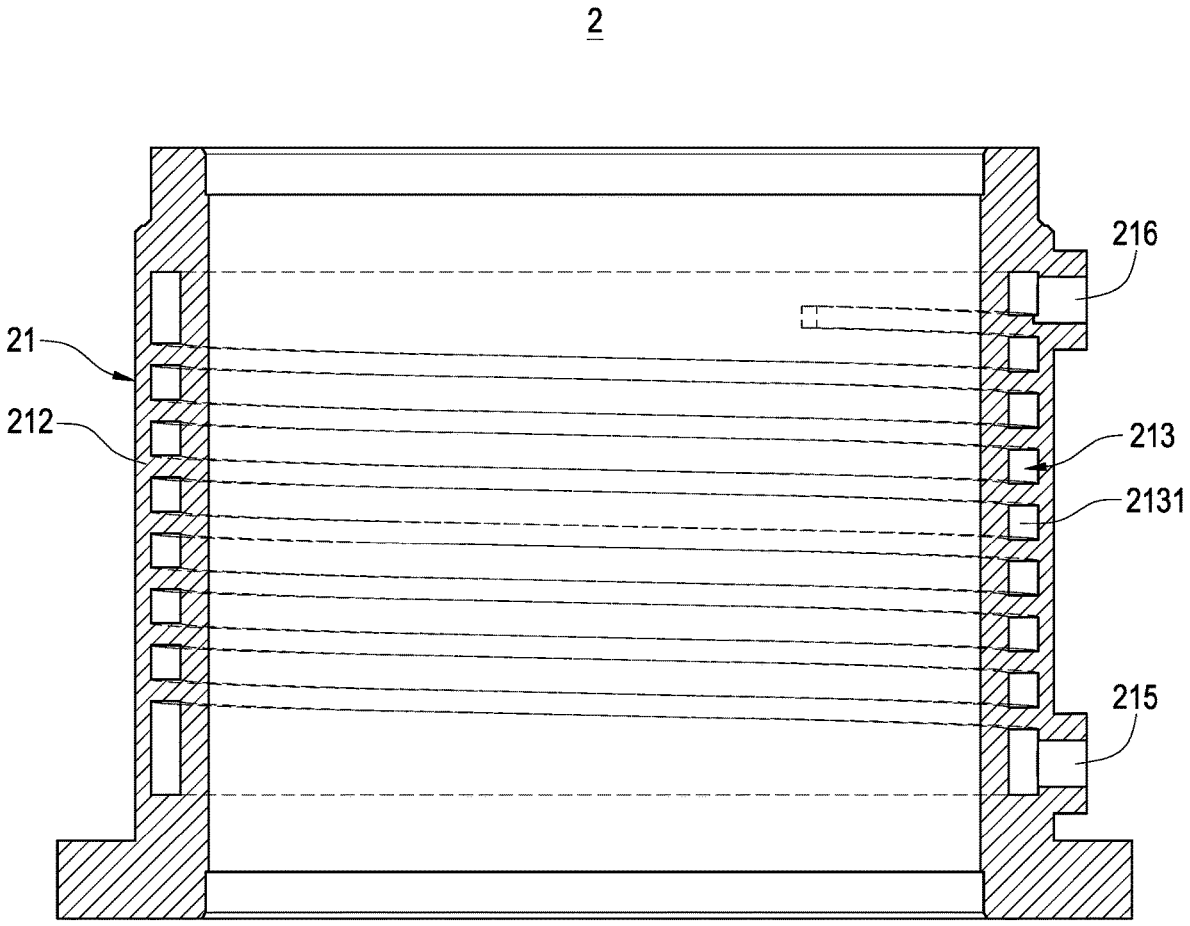
FIG. 6 is a cross-sectional view of a motor housing of this disclosure.

Furthermore, the storage tank 62 is a high-pressure tank, and the air pressure within the storage tank 62 is greater than the air pressure between the first spiral groove 17 and the second spiral groove 18 of any one of the first screw rotor 12 and the second screw rotor 13. In other words, the air pressure within the storage tank 62 is greater than the air pressure of the aforementioned initial compression operation area, so that the high-pressure coolant can be delivered sequentially from the storage tank 62, the filling tube 61, the cooling passage 213, the guide tube 7, and the first opening 112 to the compression chamber 111 by pressure difference, and finally the coolant within the compression chamber 111 will be circulated to the storage tank 62 through the tubes, so that the process of pumping the coolant and the pump component are omitted, and the structure and the volume of the rotary screw compressor 10 is simplified as well. Referring to FIGS. 3, 5 and 6, the cooling passage 213 of this embodiment is a spiral flow channel 2131, and the spiral flow channel 2131 surrounds the outer periphery of the motor housing 21, and the motor housing 21 has a second opening 215 and a third opening 216 sequentially arranged in a direction away from the compressor assembly 1. In other words, the position of the third opening 216 is higher than the position of the second opening 215, and the second opening 215 is coupled between an end of the spiral flow channel 2131 and the filling tube 61, and the third opening 216 is coupled between the other end of the spiral flow channel 2131 and the guide tube 7, so that the coolant within the cooling passage 213 can flow upwardly from the bottom. Compared with the conventional method of the coolant flowing downwardly from the top, the coolant flow will be too fast due to the force of gravity, and thus the drive motor assembly 2 cannot be cooled timely and the mixed air may be easily deteriorated. In this disclosure, the coolant within the cooling passage 213 flows upwardly from the bottom provides a uniform flow that facilitates the cooling of the drive motor assembly 2 and prevents the deterioration of the mixed air. Referring to FIGS. 1 to 4, the rotary screw compressor 10 of this disclosure further comprises an annular positioning plate 8, and the motor housing 21 has a connection port 214 configured to be corresponsive to the compressor housing 11, and a bearing seat 16 extends from an end of the compressor housing 11, and the annular positioning plate 8 is sheathed on the outer periphery of the bearing seat 16 and installed to the inner circumference of the connection port 214 in an transition-fit manner. Since the center of the annular positioning plate 8 can be aligned precisely with the axis of the bearing seat 16 and the center of the connection port 214 easily, and the annular positioning plate 8 can be detachably sealed onto the connection port 214, so that the annular positioning plate 8 has the features of convenient installation, optimal concentricity, and high sealing and anti-leaking functions.

As to the transition-fit manner mentioned previously, the tolerance between the annular positioning plate 8, the bearing seat 16, and the connection port 214 is small, and if a force greater than a predetermined external force is exerted onto the annular positioning plate 8, the annular positioning plate 8 will be sheathed on the bearing seat 16 tightly and fixed into the connection port 214 securely.

In FIG. 3, the rotary screw compressor 10 of this disclosure further comprises two first bearings 91 and two second bearings 92 installed in the compressor housing 11, and the two first bearings 91 are disposed on both ends of the first screw rotor 12 respectively, so that both ends of the first screw rotor 12 can be positioned in the compressor housing 11 by the two first bearings 91, and the two second bearings 92 are disposed on both ends of the second screw rotor 13 respectively, so that both ends of the second screw rotor 13 can be positioned in the compressor housing 11 by the two second bearings 92, and one of the first bearings 91 is clamped between the bearing seat 16 and the first screw rotor 12. Since the bearing seat 16 is extended from and integrally formed with the compressor housing 11, the rotary screw compressor 10 is simplified and compact.

In FIG. 4, the rotary screw compressor 10 of this disclosure further comprises a filter 94 and a cooler 95, wherein the cooler 95 is installed at the filling tube 61, and the filter 94 is installed at the guide tube 7, and the filter 94 is provided for filtering impurities of the coolant and the cooler 95 for provided for cooling the coolant, so that the temperature of the coolant is low.

Figure 2:
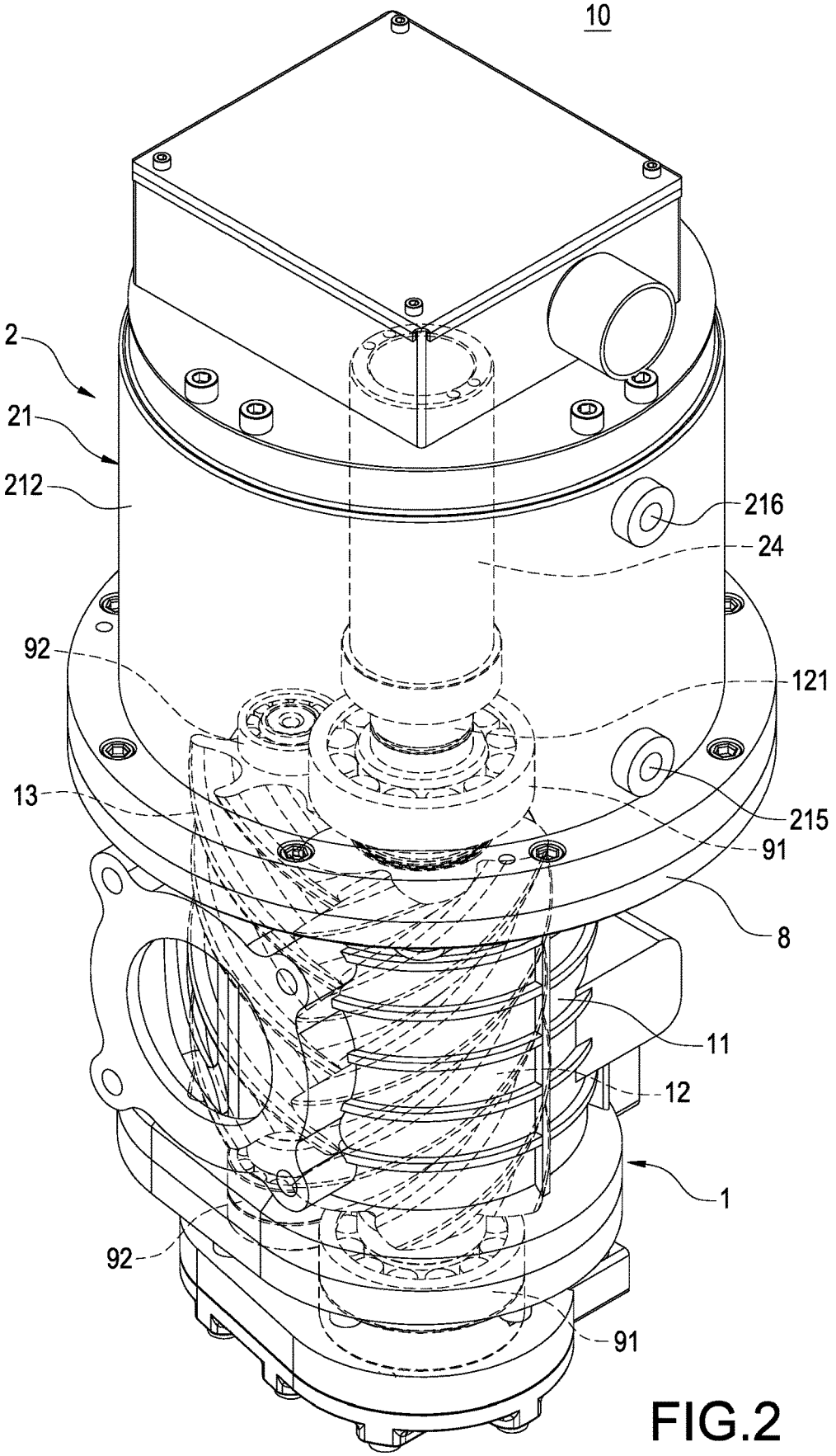
FIG. 2 is a perspective view of a rotary screw compressor of this disclosure.

As shown in FIGS. 1 to 3, the motor rotor 22 of the rotary screw compressor 10 is provided for connecting the engaging end 121 of the first screw rotor 12 directly through the centering bushing 24, so that the first screw rotor 12 can drive the second screw rotor 13 to rotate for the operation of the compressor assembly 1. This centering bushing 24 is provided to substitute the conventional drive shaft, so that both ends of the centering bushing 24 no longer require any bearing or bearing driving part, so as to reduce the accommodation space and the overall volume of the rotary screw compressor 10. The structure of the rotary screw compressor 10 is simplified as well.

In addition, the centering bushing 24 require no bearing or bearing driving part, so that it is not necessary to lubricate the coolant at both ends of the centering bushing 24, and the filling tube 61 just communicates to the cooling passage 213 only, and the guide tube 7 has an end just communicating to the cooling passage 213 only and the other end just communicating to the compression chamber 111 only, so that the coolant can flow through the motor housing 21 in order to cool the drive motor assembly 2, and the coolant does not need to flow through both ends of the centering bushing 24, so as to prevent the coolant from permeating from both ends of the centering bushing 24 into the motor housing 21, and prevent the motor rotor 22 and the motor stator 23 from being overheated or damaged, and the dirt in the motor housing 21 will not enter into the compression chamber 111, so as to extend the service life of the drive motor assembly 1.

In addition, the conventional drive shaft drives the spiral rotor to rotate by the bearing driving part, so that there will be a transmission loss. On the other hand, the motor rotor 22 of this disclosure directly connects the centering bushing 24 with the engaging end 121 of the first screw rotor 12 to reduce the transmission loss.

Further, the annular positioning plate 8 is installed between the compressor housing 11 and the motor housing 21. In other words, the annular positioning plate 8 is provided to integrate two independent assemblies (which are the compressor assembly 1 and the drive motor assembly 2) into a whole compressor assembly, so as to further reduce the volume of the rotary screw compressor 10.

In addition, the compressor assembly 1 and the drive motor assembly 2 of this embodiment are disposed in upright fashion with respect to each other, but this disclosure is not limited to such design only, and the compressor assembly 1 and the drive motor assembly 2 can also be disposed in horizontal fashion with respect to each other.

When the compressor assembly 1 and the drive motor assembly 2 are configured to be implemented in upright fashion with respect to each other, the engaging end 121 has a length ranging from one-third to half of the centering bushing 24, so that the mass of the centering bushing 24 is reduced and the center of gravity of the whole motor rotor 22 is lowered to prevent resonance occurred during the rotation of the motor rotor 22.

Figure 7:
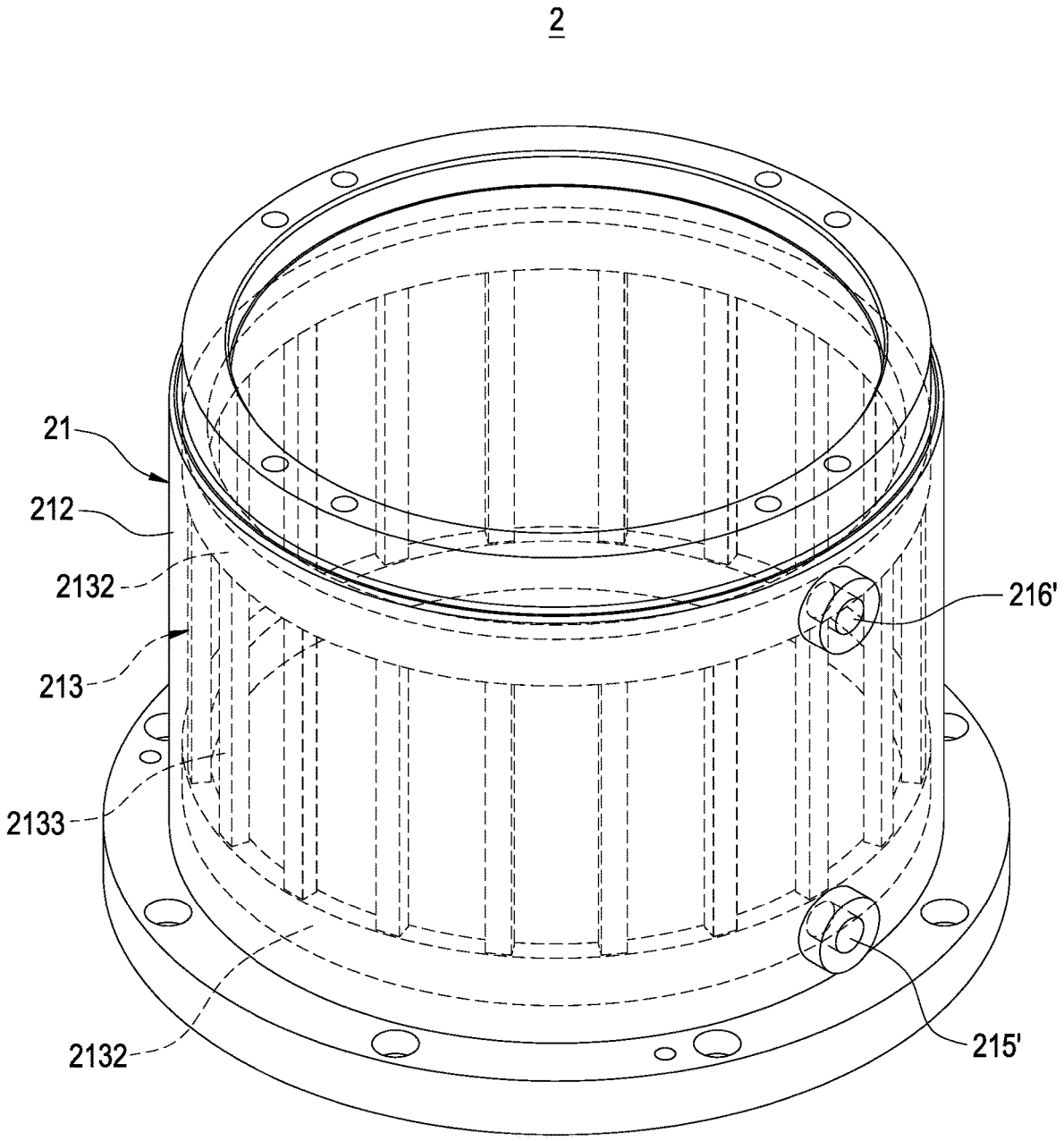
FIG. 7 is a perspective view of a motor housing in accordance to another embodiment of this disclosure.

With reference to FIG. 7 for another embodiment of the rotary screw compressor 10 of this disclosure, this embodiment as shown in FIG. 7 is substantially the same as the previous embodiment as shown in FIGS. 1 to 6, but this embodiment as shown in FIG. 7 has a different structure of the cooling passage 213.

Specifically, the cooling passage 213 comprises two circular flow channels 2132 and a plurality of straight flow channels 2133 coupled between the two circular flow channels 2132, and the plurality of straight flow channels 2133 is configured to be parallel to the axial direction of the motor housing 21, and the motor housing 21 has a second opening 215' and a third opening 216' arranged sequentially in a direction away from the compressor assembly 1. In other words, the position of the third opening 216' is higher than the position of the second opening 215', and the second opening 215' is coupled between one of the circular flow channels 2132 and the filling tube 61, and the third opening 216' is coupled between the other circular flow channel 2132 and the guide tube 7, so that the coolant at the cooling passage 213 flows upwardly from the bottom to achieve the same effects and functions as those of the previous embodiment illustrated in FIGS. 1 to 6.

While this disclosure has been described by means of specific embodiments, numerous modifications and variations could be made thereto by those skilled in the art without departing from the scope and spirit of this disclosure set forth in the claims.

What is claimed is:

1. A rotary screw compressor, comprising:

a compressor assembly, comprising a compressor housing, a first screw rotor and a second screw rotor installed in the compressor housing and engaged with each other, and an end of the first screw rotor having an engaging end;

a drive motor assembly comprising a motor housing and a motor rotor, a motor stator and a centering bushing installed in the motor housing, and the motor stator being installed within the motor rotor and driving the motor rotor to rotate, and the centering bushing being coupled to the inner circumference of the motor rotor and having an end for accommodating the engaging end, the motor rotor drives the first screw rotor to rotate through the centering bushing and the engaging end, and accommodated in the motor housing; and a filling tube, a storage tank and a guide tube, and the compressor housing having a compression chamber for accommodating the first screw rotor and the second screw rotor, and the motor housing having an inner surface, an outer surface, and a cooling passage disposed between the inner surface and the outer surface, and the filling tube having an end communicating to the storage tank and the other end communicating to the cooling passage, and the guide tube having an end communicating to the cooling passage and the other end communicating to the compression chamber, wherein both ends of the first screw rotor and the second screw rotor have an air suction end and an air exhaust end respectively, and the first screw rotor and the second screw rotor have a first spiral groove and a second spiral groove from the air suction end respectively, and the compressor housing having a first opening coupled between the compression chamber and the guide tube, and the first opening is situated between the first spiral groove and the second spiral groove of any one of the first screw rotor and the second screw rotor, wherein the cooling passage is a spiral flow channel, and the spiral flow channel surrounds the outer periphery of the motor housing, and the motor housing has a second opening and a third opening sequentially arranged in a direction away from the compressor assembly, and the second opening is coupled between an end of the spiral flow channel and the filling tube, and the third opening is coupled between the other end of the spiral flow channel and the guide tube.

2. The rotary screw compressor as claimed in claim 1, further comprising an insert key, and the engaging end having a first snap slot formed along an axis of the motor housing, and the centering bushing having a second snap slot formed along the axis of the motor housing thereof, and the insert key being snapped into the first snap slot and the second snap slot.

3. The rotary screw compressor as claimed in claim 1, further comprising a gasket and a bolt, and the engaging end having an extremity and a stop block extending therefrom, and the extremity having a first through hole, and the gasket having a second through hole, and a protrusion being protruded from an inner periphery of the centering bushing, and the bolt being locked to the first through hole and the second through hole, and the gasket being clamped between the extremity, the protrusion and the bolt, and the stop block and the centering bushing blocking and positioning with each other.

4. The rotary screw compressor as claimed in claim 1, wherein the storage tank has an internal pressure greater than the air pressure between the first spiral groove and the second spiral groove of any one of the first screw rotor and the second screw rotor.

5. The rotary screw compressor as claimed in claim 1, further comprising a filter and a cooler, and the cooler being installed at the filling tube, and the filter being installed at the guide tube.

6. The rotary screw compressor as claimed in claim 1, further comprising an annular positioning plate, and the motor housing having a connection port corresponding to the compressor housing, and a bearing seat extending from an end of the compressor housing, and the annular positioning plate being sheathed on the outer periphery of the bearing seat and passed into the inner circumference of the connection port in a transition-fit manner, and the annular positioning plate being detachably sealed onto the connection port.

7. The rotary screw compressor as claimed in claim 6, further comprising two first bearings and two second bearings accommodated in the compressor housing, and the two first bearings being disposed on both ends of the first screw rotor respectively, and the two second bearings being disposed on both ends of the second screw rotor respectively, and one of the first bearings being clamped between the bearing seat and the first screw rotor.

8. The rotary screw compressor as claimed in claim 1, wherein the compressor assembly and the drive motor assembly are perpendicular or parallel to each other.

9. A rotary screw compressor, comprising:

a compressor assembly, comprising a compressor housing, a first screw rotor and a second screw rotor installed in the compressor housing and engaged with each other, and an end of the first screw rotor having an engaging end;

a drive motor assembly comprising a motor housing and a motor rotor, a motor stator and a centering bushing installed in the motor housing, and the motor stator being installed within the motor rotor and driving the motor rotor to rotate, and the centering bushing being coupled to the inner circumference of the motor rotor and having an end for accommodating the engaging end, the motor rotor drives the first screw rotor to rotate through the centering bushing and the engaging end; and a filling tube, a storage tank and a guide tube, and the compressor housing having a compression chamber for accommodating the first screw rotor and the second screw rotor, and the motor housing having an inner surface, an outer surface, and a cooling passage disposed between the inner surface and the outer surface, and the filling tube having an end communicating to the storage tank and the other end communicating to the cooling passage, and the guide tube having an end communicating to the cooling passage and the other end communicating to the compression chamber, wherein the engaging end has a length ranging from one-third to half of the length of the centering bushing, wherein both ends of the first screw rotor and the second screw rotor have an air suction end and an air exhaust end respectively, and the first screw rotor and the second screw rotor have a first spiral groove and a second spiral groove from the air suction end respectively, and the compressor housing having a first opening coupled between the compression chamber and the guide tube, and the first opening is situated between the first spiral groove and the second spiral groove of any one of the first screw rotor and the second screw rotor, wherein the cooling passage comprises two circular flow channels and a plurality of straight flow channels coupled between the two circular flow channels, the plurality of straight flow channels extend in a direction parallel to axis of the motor housing, and the motor housing has a second opening and a third opening sequentially arranged in a direction away from the compressor assembly, and the second opening is coupled between one of the circular flow channels and the filling tube, and the third opening is coupled between the other circular flow channel and the guide tube.

10. The rotary screw compressor as claimed in claim 9, further comprising an insert key, and the engaging end having a first snap slot formed along the axis thereof, and the centering bushing having a second snap slot formed along the axis thereof, and the insert key being snapped into the first snap slot and the second snap slot.

11. The rotary screw compressor as claimed in claim 9, further comprising a gasket and a bolt, and the engaging end having an extremity and a stop block extending therefrom, and the extremity having a first through hole, and the gasket having a second through hole, and a protrusion being protruded from an inner periphery of the centering bushing, and the bolt being locked to the first through hole and the second through hole, and the gasket being clamped between the extremity, the protrusion and the bolt, and the stop block and the centering bushing blocking and positioning with each other.

12. The rotary screw compressor as claimed in claim 9, wherein the storage tank has an internal pressure greater than the air pressure between the first spiral groove and the second spiral groove of any one of the first screw rotor and the second screw rotor.

13. The rotary screw compressor as claimed in claim 9, further comprising a filter and a cooler, and the cooler being installed at the filling tube, and the filter being installed at the guide tube.

14. The rotary screw compressor as claimed in claim 9, further comprising an annular positioning plate, and the motor housing having a connection port corresponding to the compressor housing, and a bearing seat extending from an end of the compressor housing, and the annular positioning plate being sheathed on the outer periphery of the bearing seat and passed into the inner circumference of the connection port in a transition-fit manner, and the annular positioning plate being detachably sealed onto the connection port.

15. The rotary screw compressor as claimed in claim 14, further comprising two first bearings and two second bearings accommodated in the compressor housing, and the two first bearings being disposed on both ends of the first screw rotor respectively, and the two second bearings being disposed on both ends of the second screw rotor respectively, and one of the first bearings being clamped between the bearing seat and the first screw rotor.

16. The rotary screw compressor as claimed in claim 9, wherein the compressor assembly and the drive motor assembly are perpendicular or parallel to each other.

* * * * *